US005628494A

United States Patent [19]

Arnold

[11] Patent Number: 5,628,494

[45] Date of Patent: May 13, 1997

[54] FENCE PANEL ASSEMBLY AND FENCE

[76] Inventor: James L. Arnold, 6223 Greenway Forest, Houston, Tex. 77088

[21] Appl. No.: 458,466

[22] Filed: Jun. 1, 1995

Related U.S. Application Data

[63] Continuation of Ser. No. 36,149, Mar. 24, 1993, Pat. No. 5,441,240.

[51] Int. Cl.[6] ..... E04H 17/16

[52] U.S. Cl. ..... 256/24; 256/19; 256/59; 256/66

[58] Field of Search ..... 256/19, 24, 27, 256/59, 65, 66, 68, 72, DIG. 5

[56] References Cited

U.S. PATENT DOCUMENTS

| | | | |
|---|---|---|---|
| 2,877,989 | 3/1959 | Brodersen | 256/19 |
| 3,136,530 | 6/1964 | Case | 256/65 |
| 3,303,622 | 2/1967 | Minds | 256/24 |
| 3,342,458 | 9/1967 | Simonton | 256/24 |
| 3,393,896 | 7/1968 | Poland | 256/24 |
| 3,993,289 | 11/1976 | Lewis et al. | 256/59 |
| 4,202,532 | 5/1980 | Mills | 256/24 |
| 4,324,388 | 4/1982 | Klaser | 256/66 |
| 4,471,947 | 9/1984 | Osborne | 256/24 |
| 4,809,955 | 3/1989 | Veilleux | 256/19 |
| 5,078,367 | 1/1992 | Simpson et al. | 256/19 |
| 5,441,240 | 8/1995 | Arnold | 256/24 |

FOREIGN PATENT DOCUMENTS

| | | | |
|---|---|---|---|
| 2241000 | 8/1991 | United Kingdom | 256/24 |

*Primary Examiner*—Louis J. Casaregola
*Assistant Examiner*—William Wicker
*Attorney, Agent, or Firm*—Rosenblatt & Redano, P.C.

[57] ABSTRACT

The present invention relates to a fence panel assembly and fence that do not permit a line of vision from one side of the panels between the panels to the other side of the panels while still providing ventilation channels between the panels for resistance to high wind.

16 Claims, 3 Drawing Sheets

FENCE PANEL ASSEMBLY AND FENCE

CROSS REFERENCE TO RELATED APPLICATIONS

This application is a continuation of U.S. application Ser. No. 08/036,149, filed on Mar. 24, 1993, now U.S. Pat. No. 5,441,240.

BACKGROUND OF THE INVENTION

1. Field of the Invention

The present invention relates to a fence panel assembly and fence that do not permit a line of vision from one side of the panels between the panels to the other side of the panels while still providing ventilation channels between the panels for resistance to high wind.

2. Description of the Prior Art

A variety of fence devices have been used to provide the fence owner with protection and privacy. Prior art fence devices have consisted of fence posts, vertical panels, and horizontal mounting members.

Prior art fences are typically assembled with mechanical fasteners such as bolts, nuts, screws, nails or slipnotch fasteners. The use of multiple mechanical attachments, such as those disclosed in U.S. Pat. Nos. 4,324,388; 3,993,289; 4,471,947; 4,809,955; and 4,202,532, results in time consuming assembly.

Prior art fences typically are open fences such as those disclosed in U.S. Pat. Nos. 4,202,532; 4,809,955; 4,324,388; and 3,993,289. These fences do not provide privacy to the fence owner. The spaces that exist between conventional fence panels often increase in size over time as a result of warping, aging, shrinking, or rotting of the panels. Prolonged exposure of the fence panels to adverse environmental conditions such as sunlight, rain, and wind can weaken the structural integrity of the fence. A closed fence design, such as that disclosed in U.S. Pat. No. 4,471,947, does not provide ventilation for wind or rain forces. Such a design is more likely to be blown over in a high wind than a fence with spaces between panels.

Many prior art fence panels are composed of wood, metal, or plastic resins. These materials require periodic maintenance and are difficult to assemble.

Prior art fence devices fail to solve the problem of providing privacy by not permitting a line of vision between the fence panels and providing resistance to high winds by providing ventilation channels between the fence panels.

The present invention overcomes the problems of the prior art by requiring minimal use of mechanical fasteners and easy assembly of the fence, and providing ventilation channels between fence panels while not permitting a line of vision between adjacent panels. The present invention is uniquely designed to allow the fence panels to successively slide onto two horizontal stringers. The fence panel edges are designed to overlap the edges of adjoining fence panel to form a closed fence with ventilation air channels. This provides the fence owner with privacy and a weather resistant fence. The fence panels and stringers of the present invention are made of a vinyl material. This material is light and requires little to no maintenance.

SUMMARY OF THE INVENTION

The present invention relates to a fence panel assembly and a fence that do not permit a line of vision through the fence or the fence panel assembly. The fence panels are uniquely designed to form angulated ventilation channels that resist rain and wind abuse.

Fence posts are driven into the ground to provide a mounting assembly for the placement of the stringers. The required number and height of the fence posts will vary with the individual fence owner's needs. Two substantially parallel horizontal mounting members, such as stringers, are secured in a substantially horizontal orientation to the fence posts by mechanical fasteners such as bolts and nuts. The stringers run the full length of the fence and comprise upper and lower lobed wings that engage the fence panels.

The fence panels are arranged in a substantially perpendicular orientation to the stringers. A plurality of fence panels, each with upper and lower mounting channels, slidably engage the lobed wings of the two stringers. Each panel comprises a front channel border and a rear channel border extending outwardly from opposite sides of the central body region of the panel. At least one spacer member slidably engages the rear channel border in a substantially perpendicular configuration to each fence panel. The spacer member is attached to ensure maintenance of a uniform distance between the adjacent fence panels and may be of various sizes to accommodate the desired distance between panels. The overlap of these borders forms angulated channels for ventilation. As used herein, the term "angulated channel" means a channel comprising a bend or an angle of sufficient magnitude such that an air current entering one end of the channel must change direction in order to exit the other end of the channel, as shown in FIG. 3. Line of sight vision from one side of the fence, between the panels, to the other side is not permitted by the overlap of the front channel border with the rear channel border of adjoining fence panels.

The angulated channels permit a flow of air between the two adjacent fence panels, which enhances the structural integrity of the fence during adverse environmental conditions such as rain and high winds.

Arch panel members connect the fence panel assemblies at substantially right angles. The use of the arch panel members permits a combination of four fence panel assemblies to enclose a substantially rectangular area. Two extension arms extend outward from the arch panel member. The extension arms are attached to fence panels located at one end of each fence panel assembly. The stringers are secured to fence posts by mechanical fasteners.

The fence panels and fence posts may be equipped with a plurality of caps. The cap slidably fits over the top of the panel or post.

The fence posts may be of a galvanized metal and the stringers, fence panels, arch panel members, spacer and caps may be made of a vinyl material. The fence and fence panel assembly design of the present invention may be easily assembled.

DESCRIPTION OF THE PREFERRED EMBODIMENTS

Figure 2:
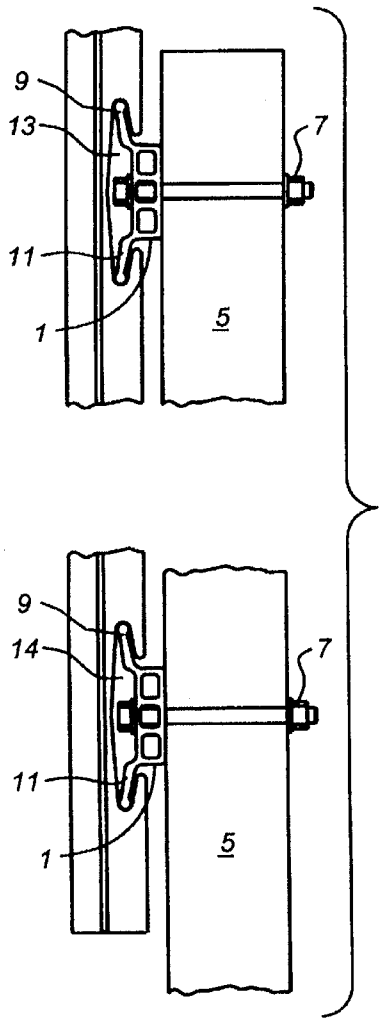
FIG. 2 is a side view of the invention.
Figure 1:
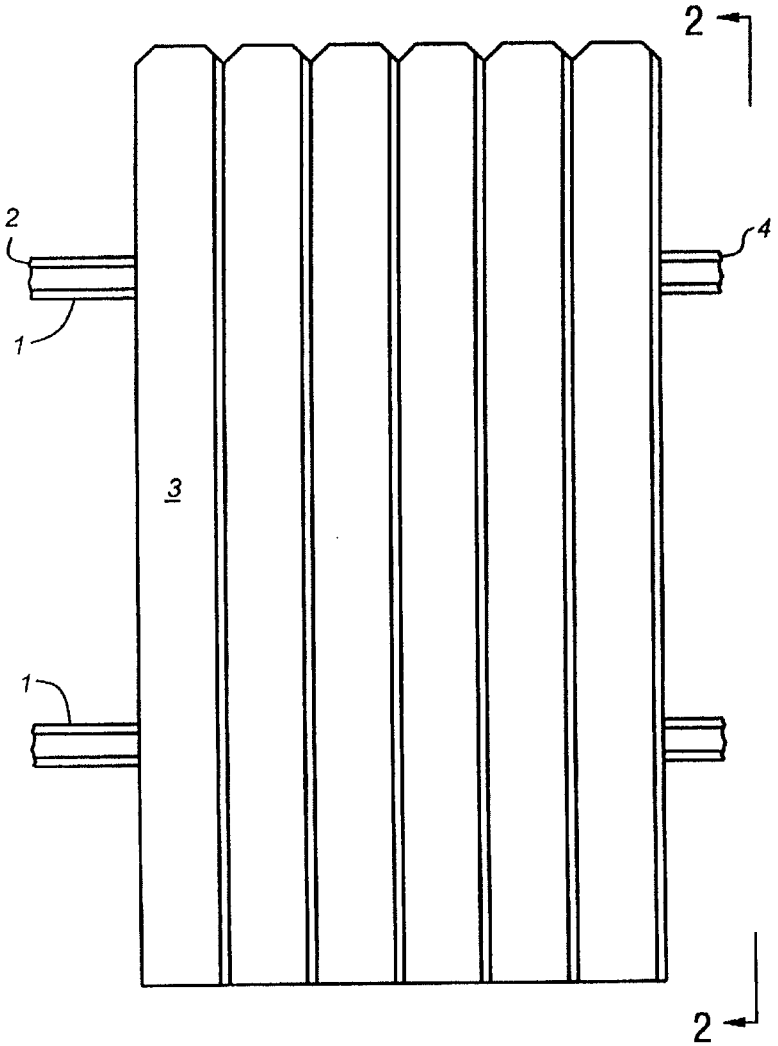
FIG. 1 is a front view of the invention.

As shown in FIGS. 1 and 2, the fence embodiment of the present invention comprises two stringers 1 in a substantially parallel arrangement, each of said stringers comprising a mounting assembly 7 capable of securing the stringer to a fence post 5. The fence embodiment further comprises a plurality of fence panels 3 slidably mounted on the stringers in a substantially parallel arrangement. Each of the fence panels is mounted in a substantially perpendicular configuration to the stringers. The fence panels further comprise angulated channels 25 capable of permitting air flow between the fence panels such that the fence panels are capable of being spaced apart with respect to each other so as not to permit a line of vision from one side of the fence panels between the fence panels to the other side of the fence panels while permitting air flow through the angulated channels, as shown in FIGS. 3 and 4.

In a preferred embodiment, the stringers comprise an upper lobed wing 9 and a lower lobed wing 11. The fence panels comprise an upper mounting channel 13 and a lower mounting channel 14, capable of slidably engaging the upper lobed wing and lower lobed wing, respectively, of the stringers. The upper lobed wing and lower lobed wing of the stringer extend substantially the length of the stringer.

Figure 3:
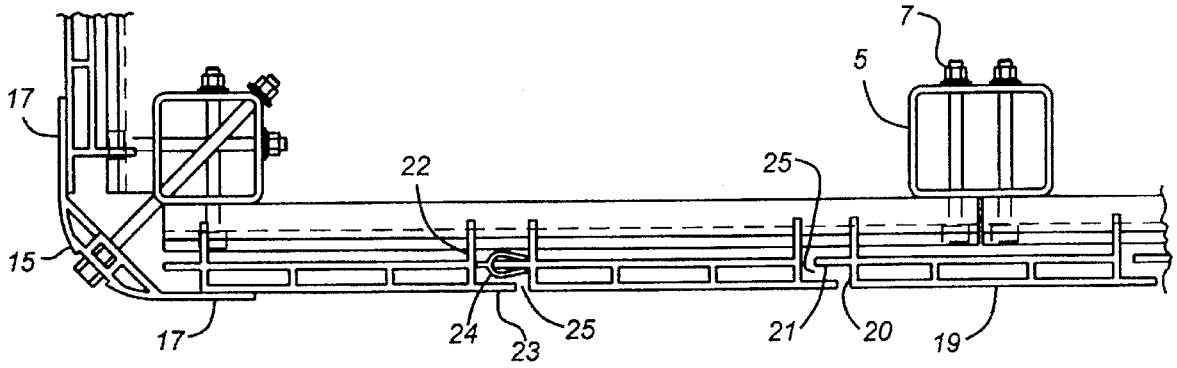
FIG. 3 is a top view of the invention.
Figure 6:
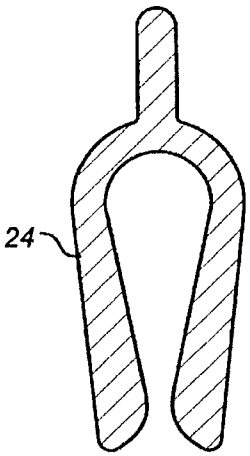
FIG. 6 is an end view of the spacer member.

In a preferred embodiment, as shown in FIG. 3, the panels comprise a central body region 19 comprising a first side 20 and a second side 22. A rear channel border 21 extends outward from the first side of the central body region and a front channel border 23 extends outward from the second side of the central body region. The spacer member 24, as shown in FIGS. 3 and 6, is capable of maintaining uniform distance between adjacent fence panels. The spacer member slidably engages the rear channel border as shown in FIG. 3. The angulated channel 25 is formed by the overlap of the front channel border of one panel with the rear channel border of an adjacent panel. The angulated channel extends the length of the fence panel, as shown in FIG. 4. As used herein, the term "front side of the panels" is that side of the fence panels depicted in FIG. 4. As used herein, the term "rear side of the panels" is that side of the fence panels opposite to the front side of the panels. As shown in FIGS. 3 and 4, the angulated channels permit air flow from the front side of the panels, between the panels, to the rear side of the panels.

Figure 4:
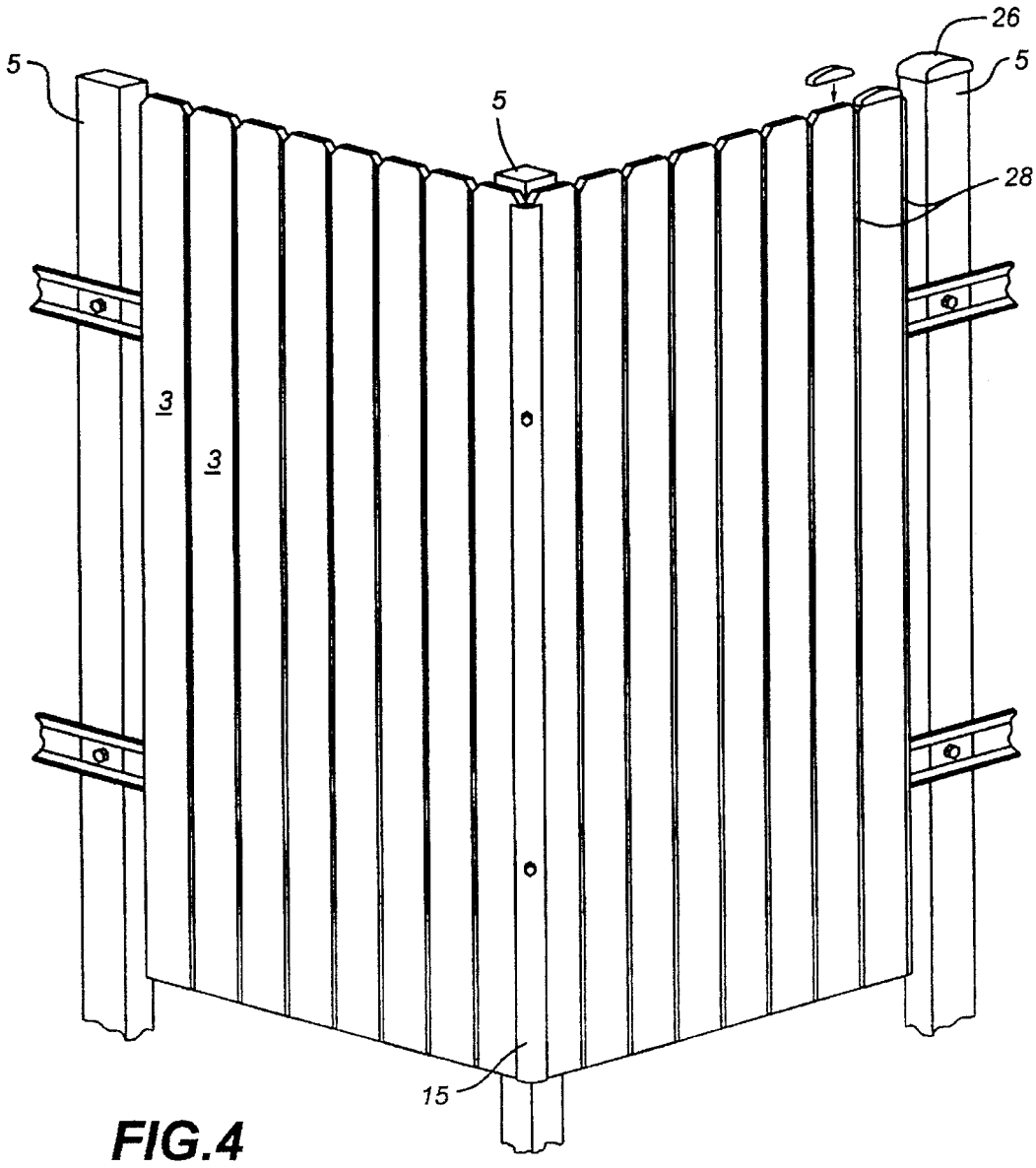
FIG. 4 is an isometric view of the invention.

In another preferred embodiment, as shown in FIG. 4, the present invention is a fence comprising a first pair of stringers in a substantially parallel arrangement, where each end of the stringers is mounted to a fence post 5. The respective ends of the stringers are referred to as the first end 2 and the second end 4. A plurality of fence panels are slidably mounted on the first pair of stringers in a substantially parallel arrangement extending from the first end to the second end of the stringers. Each of the panels is mounted in a substantially perpendicular configuration to the first pair of stringers. Each panel comprises substantially angulated channels capable of permitting air flow between the fence panels. The panels are capable of being spaced apart with respect to each other so as not to permit a line of vision from one side of the panels between the panels to the other side of the panel while permitting air flow through the angulated channel.

Figure 5:
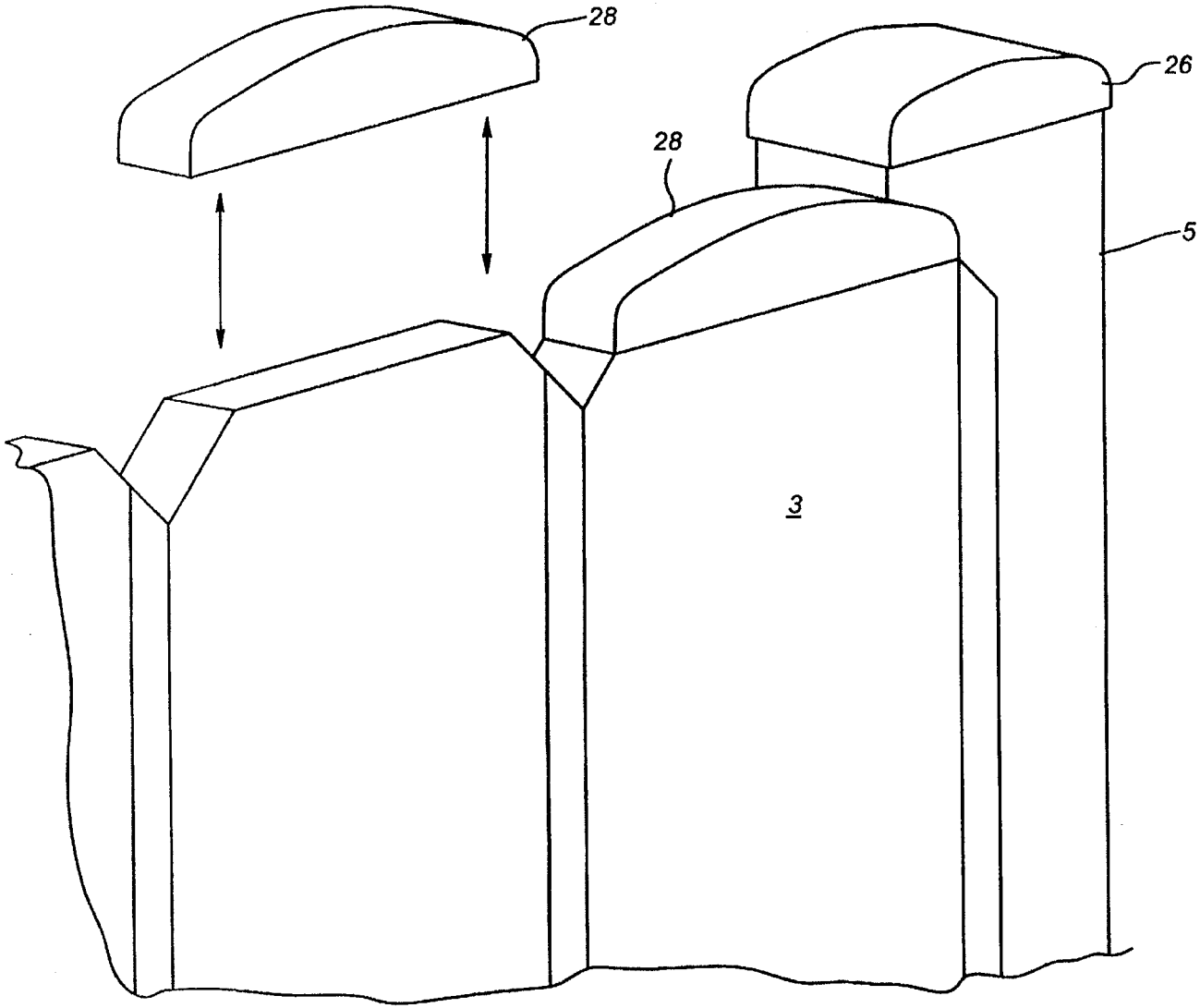
FIG. 5 is an isometric view of the fence post and panel caps.

This preferred embodiment of the invention further comprises a plurality of fence post caps 26 and fence panel caps 28, as shown in FIG. 5, where the caps are slidably mounted on the top surface of the posts and panels.

This preferred embodiment of the invention further comprises a second pair of stringers in a substantially parallel arrangement, where each end of the stringers is mounted to a fence post 5. The respective ends of this second pair of stringers are referred to as first ends and second ends. A second plurality of fence panels is slidably mounted on the second pair of stringers in the same manner that the first plurality of fence panels is mounted on the first pair of stringers. This embodiment of the invention further comprises an arch panel member 15 comprising two extension arms 17 extending outward from the arch panel member in a substantially perpendicular arrangement to each other. The first extension member is attached to a panel at one end of the first pair of stringers and the second extension member is attached to a panel at one end of the second pair of stringers such that the first pair and second pair of stringers are arranged at a substantially right angle, as shown in FIGS. 3 and 4.

In another preferred embodiment of the present invention, the stringers are mounted to the fence posts by a mechanical fastener, such as a nut and bolt assembly 7, as shown in FIG. 3. In a preferred embodiment, the fence panels are made of vinyl material.

Another preferred embodiment of the present invention is a fence panel assembly comprising two fence panels capable of being slidably mounted adjacent each other in a substantially parallel arrangement on two horizontal mounting members, such as stringers, as shown in FIG. 1. The fence panel assembly comprises substantially angulated channels capable of permitting air flow between the fence panels. The panels are capable of being spaced apart with respect to each other so as not to permit a line of vision from one side of the panels between the panels to the other side of the panels while permitting air flow through the angulated channels. In a preferred embodiment, the fence panels comprise an upper mounting channel and a lower mounting channel capable of slidably engaging each horizontal mounting member.

Many modifications and variations may be made in the embodiments described herein and depicted in the accompanying drawings without departing from the concept of the present invention. Accordingly, it is clearly understood that the embodiments described and illustrated herein are illustrative only and are not intended as a limitation upon the scope of the present invention.

What is claimed is:

1. A fence for mounting on a fence post, comprising:

a) two panel stringers in a substantially parallel arrangement, each of said stringers comprising an upper lobed wing, a lower lobed wing, and a mounting assembly capable of securing said stringer to a fence post; and b) a plurality of fence panels slidably mounted on said stringers in a substantially parallel arrangement, each of said panels mounted in a substantially perpendicular configuration to said stringers, said fence panels comprising angulated channels capable of permitting air flow between said fence panels, said panels being capable of being spaced apart with respect to each other so as not to permit a line of vision from any distance from one side of said panels between said panels to the other side of said panels while permitting air flow from the front side of the panels through said angulated channels to the rear side of the panels.

2. The fence of claim 1, wherein said fence panels comprise an upper mounting channel and a lower mounting channel, each of said mounting channels capable of slidably engaging said upper lobed wing and said lower lobed wing of one of said stringers.

3. The fence of claim 1, wherein said upper lobed wing and said lower lobed wing extend laterally the length of said panel stringer.

4. The fence of claim 1, wherein said angulated channels extend the vertical length of said fence panels.

5. The fence of claim 4, wherein said panels comprise:

a) a central body region comprising a first side and a second side;

b) a rear channel border extending outward from said first side of said central body region; and c) a front channel border extending outward from said second side of said central body region.

6. The fence of claim 5, wherein said angulated channels are formed by the overlap of said front channel border of one panel with said rear channel border of an adjacent panel.

7. The fence of claim 5, wherein said rear channel border slidably engages at least one spacer member capable of maintaining uniform distances between said fence panels.

8. A fence comprising:

a) a first pair of stringers in a substantially parallel arrangement, said first pair of stringers comprising an upper lobed wing, a lower lobed wing, a first end and a second end;

b) a first fence post to which the first end of said first pair of stringers is mounted:

c) a first plurality of fence panels, slidably mounted on said first pair of stringers in a substantially parallel arrangement extending from said first end to said second end of said first pair of stringers, each of said panels mounted in a substantially perpendicular configuration to said first pair of stringers, said first plurality of panels comprising angulated channels capable of permitting air flow between said fence panels, said first plurality of panels being capable of being spaced apart with respect to each other so as not to permit a line of vision from any distance from one side of said first plurality of panels between said panels to the other side of said first plurality of panels while permitting air flow through said angulated channels; and d) a second fence post to which the second end of said first pair of stringers is mounted.

9. The fence of claim 8, further comprising:

a) a second pair of stringers in a substantially parallel arrangement, said second pair of stringers comprising a first end, and a second end wherein the first end of said second pair of stringers is mounted to said second fence post;

b) a second plurality of fence panels, slidably mounted on said second pair of stringers in a substantially parallel arrangement extending from said second end to said second end of said second pair of stringers, each of said panels mounted in a substantially perpendicular configuration to said second pair of stringers, said second plurality of panels comprising substantially angulated channels capable of permitting air flow between said fence panels, said second plurality of panels being capable of being spaced apart with respect to each other so as not to permit a line of vision from one side of said second plurality of panels between said panels to the other side of said second plurality of panels while permitting air flow through said angulated channels;

c) an arch panel member comprising two extension arms extending outward from said arch panel member in a substantially perpendicular arrangement to each other, said first extension member attached to a panel at one end of said first pair of stringers and said second extension member attached to a panel at one end of said second pair of stringers, such that said first pair and second pair of stringers are arranged at a substantially right angle; and d) a third fence post to which the second end of said second pair of stringers is mounted.

10. The fence of claim 9, wherein said stringers are mounted to said fence posts by a mechanical fastener.

11. The fence of claim 9, further comprising:

a) a fence post cap slidably mounted on the top surface of said fence posts; and b) a fence panel cap slidably mounted on the top surface of said fence panels.

12. The fence of claim 9, wherein said first pair of stringers and said second pair of stringers comprise an upper lobed wing and a lower lobed wing extending substantially the length of said stringers.

13. The fence of claim 9, wherein said angulated channels extends substantially the vertical length of said fence panels.

14. Two fence panels capable of being slidably mounted adjacent each other in a substantially parallel arrangement on two horizontal mounting members, said panels comprising angulated channels capable of permitting air flow from the front side of the panels between said fence panels to the rear side of the panels, said panels being capable of being spaced apart with respect to each other so as not to permit a line of vision from any distance from one side of said panels between said panels to the other side of said panels while permitting air flow through said angulated channels, wherein each of said panels comprise an upper mounting channel and a lower mounting channel capable of slidably engaging each horizontal mounting member.

15. The fence panels of claim 14, wherein said panels comprise:

a) a central body region comprising a first side and a second side;

b) a rear channel border extending outward from said first side of said central body region; and c) a front channel border extending outward from said second side of said central body region.

16. The fence panels of claim 15, wherein said angulated channels are formed by the overlap of said front channel border of one fence panel with said rear channel border of the other fence panel.

* * * * *